US006362804B1

(12) United States Patent
Park et al.

(10) Patent No.: US 6,362,804 B1
(45) **Date of Patent: *Mar. 26, 2002**

(54) LIQUID CRYSTAL DISPLAY WITH PICTURE DISPLAYING FUNCTION FOR DISPLAYING A PICTURE IN AN ASPECT RATIO DIFFERENT FROM THE NORMAL ASPECT RATIO

(75) Inventors: Joon Ha Park, Kumi; Jong Sang Baek, Kyongsangbuk-do, both of (KR)

(73) Assignee: L G Electronics Inc., Seoul (KR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/079,169

(22) Filed: May 15, 1998

(30) Foreign Application Priority Data

May 17, 1997 (KR) ..... 97-19140

(51) Int. Cl.[7] ..... G09G 3/36
(52) U.S. Cl. ..... 345/99; 345/100; 345/204
(58) Field of Search ..... 345/99, 100, 103, 345/204, 211, 214, 212, 213; 348/445, 634

(56) References Cited

U.S. PATENT DOCUMENTS 5,748,175 A * 5/1998 Shimada et al. ..... 345/127
5,805,132 A * 9/1998 Imaizumi et al. ..... 345/145
5,844,539 A * 12/1998 Kitagawa ..... 345/100
5,903,253 A * 5/1999 Mizutome et al. ..... 345/132

FOREIGN PATENT DOCUMENTS

| | | |
|---|---|---|
| JP | 03-131181 | 6/1991 |
| JP | 06-027903 | 2/1994 |
| JP | 07-261705 | 10/1995 |
| JP | 8-234698 | 9/1996 |
| KR | 1995-7496 | 3/1995 |
| KR | 1996-8663 | 3/1996 |

* cited by examiner

*Primary Examiner*—Bipin Shalwala
*Assistant Examiner*—Mansour M. Said
(74) *Attorney, Agent, or Firm*—Finnegan, Henderson, Farabow, Garrett & Dunner LLP

(57) ABSTRACT

A liquid crystal display apparatus and method for displaying a picture different in aspect ratio than the liquid crystal panel. Picture data sampling times are controlled for a first signal electrode driver that drives signal electrodes in a region where a picture different in aspect ratio from the liquid crystal panel is to be displayed and a second signal electrode driver for driving signal electrodes in a region where picture data different in aspect ratio from the liquid crystal panel is not to be displayed. In particular, the starting points of the picture data sampling is controlled in accordance with the picture data's aspect ratio. With the disclosed apparatus and method, it is possible to display a picture different in aspect ratio from the liquid crystal display along with a blanking picture without introducing excessive noise, and the circuit configuration of the liquid crystal display is simplified.

14 Claims, 9 Drawing Sheets

LIQUID CRYSTAL DISPLAY WITH PICTURE DISPLAYING FUNCTION FOR DISPLAYING A PICTURE IN AN ASPECT RATIO DIFFERENT FROM THE NORMAL ASPECT RATIO

BACKGROUND OF THE INVENTION

1. Field of the Invention

This invention relates to a liquid crystal display (LCD), and more particularly to a liquid crystal display apparatus and method wherein pictures having an aspect ratio different from the liquid crystal panel's normal aspect ratio can be displayed.

2. Description of Prior Art

Recently, there has been a general tendency to provide a picture with an aspect ratio of 16 to 9. This type of "wide picture" has a longer horizontal axis than the existing "normal" picture having an aspect ratio of 4 to 3, thereby providing a more comfortable viewing area. In these wide screen LCDs, in order for the liquid crystal display to have the wide aspect ratio, its horizontal axis is made longer than conventional LCDs. However, it is desirable to have the "wide picture" LCDs capable of displaying a wide picture as well as a normal picture.

When the wide picture LCDs display a normal picture in the aspect ratio of 4 to 3 on the liquid crystal panel, it has to provide blanking i.e., a black display on the display region, shown by oblique lines in FIG. 1 on the left and right side thereof. In order to obtain this, conventional wide LCDs vary the frequency of a sampling clock for sampling the original picture data to thereby control the aspect ratio of the picture. However, this tends to produce a residual picture outside of the picture region in the aspect ratio of 4 to 3. Also, undesirable noise due to a horizontal synchronous signal pulse may be displayed on the left and right side region of the screen in the blanking area. Further, the conventional wide picture LCD apparatus has to combine the quasi-picture data to be displayed on the blanking display region with the original picture data and drive the liquid crystal panel with the combined picture data, in addition to the variation of the sampling clock of the picture data. This results in a complicated circuit configuration.

In an effort to overcome the above disadvantage in the conventional wide LCD apparatus, a liquid Crystal display device was disclosed in Japanese Patent laid-open publication No. Puyng 8-234698, published on Sep. 13, 1996 and filed by the Casio Co. Ltd. Here, when the wide liquid crystal display device displays the normal picture, it separately controls the sampling time of both the signal electrode drivers positioned in the liquid crystal panel on which the normal picture is to be displayed and the signal electrode drivers positioned in the liquid crystal panel on which the normal picture is not to be displayed. As a result, the liquid crystal display device could provide a blanking display on the left and right side area of the wide liquid crystal panel on which the normal picture was not displayed. However, in order to separately drive the signal electrode drivers, it is necessary to include separate picture data supply lines and concomitant circuitry. Due to this, the above liquid crystal display device has drawback in that its circuit configuration is complicated.

SUMMARY OF THE INVENTION

Accordingly, it is an object of the present invention to provide a liquid crystal display apparatus and method with a picture displaying function of different aspect ratio which can display on a liquid crystal panel a blanking picture without an inclusion of noise along with a picture an aspect ratio of which is different from that of the liquid crystal panel.

It is other object of the present invention to provide a liquid crystal display apparatus and method with a picture displaying function of different aspect ratio which can simplify a circuit configuration thereof.

In order to obtain the above objects, according to an aspect of the present invention, there is provided a liquid crystal display apparatus which comprises: (1) first signal electrode driving means for driving signal electrodes in a main region where the picture in a first or second aspect ratio is displayed; (2) second signal electrode driving means for driving signal electrodes in a peripheral region adjacent the main region where the picture in only one of the first and second aspect ratios, but not the picture in the other of the first and second aspect ratios, is displayed; and (3) timing control means for varying a picture data sampling start time of said first and second signal electrode driving means in accordance with the selected one of said first and second aspect ratios.

Furthermore, according to another aspect of the present invention, there is provided a method comprising the steps of: (1) driving first signal electrodes in a main region where the picture in a first or second aspect ratio is displayed; (2) driving second signal electrodes in a peripheral region adjacent the main region, where the picture in only one of the first and second aspect ratios but not the picture in the other of the first and second aspect ratios is displayed; and (3) varying a picture data sampling start time of said first and second signal electrodes in accordance with the selected one of the first and second aspect ratios.

BRIEF DESCRIPTION OF THE DRAWINGS

The above and other objects and features of the present invention will become more apparent from the following description taken in connection with the accompanying drawings, in which.

DETAILED DESCRIPTION OF THE PREFERRED EMBODIMENT

Figure 1:
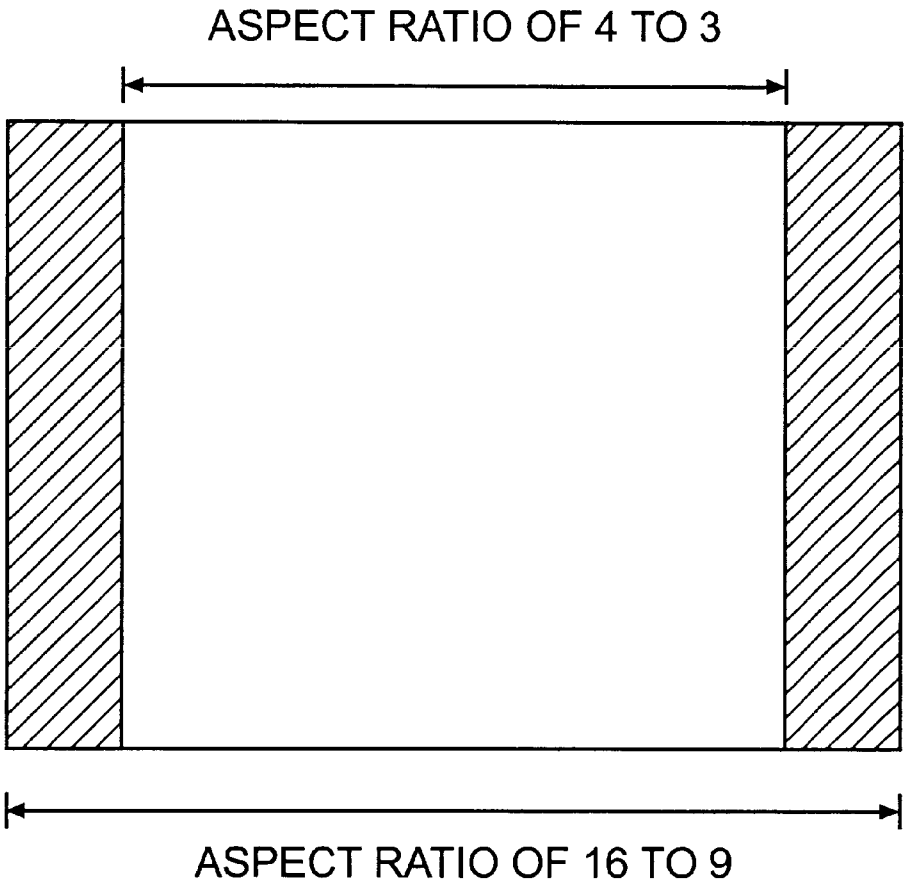
FIG. 1 is a diagram showing a state of a liquid crystal panel on which a picture of different aspect ratio is displayed.
Figure 2:
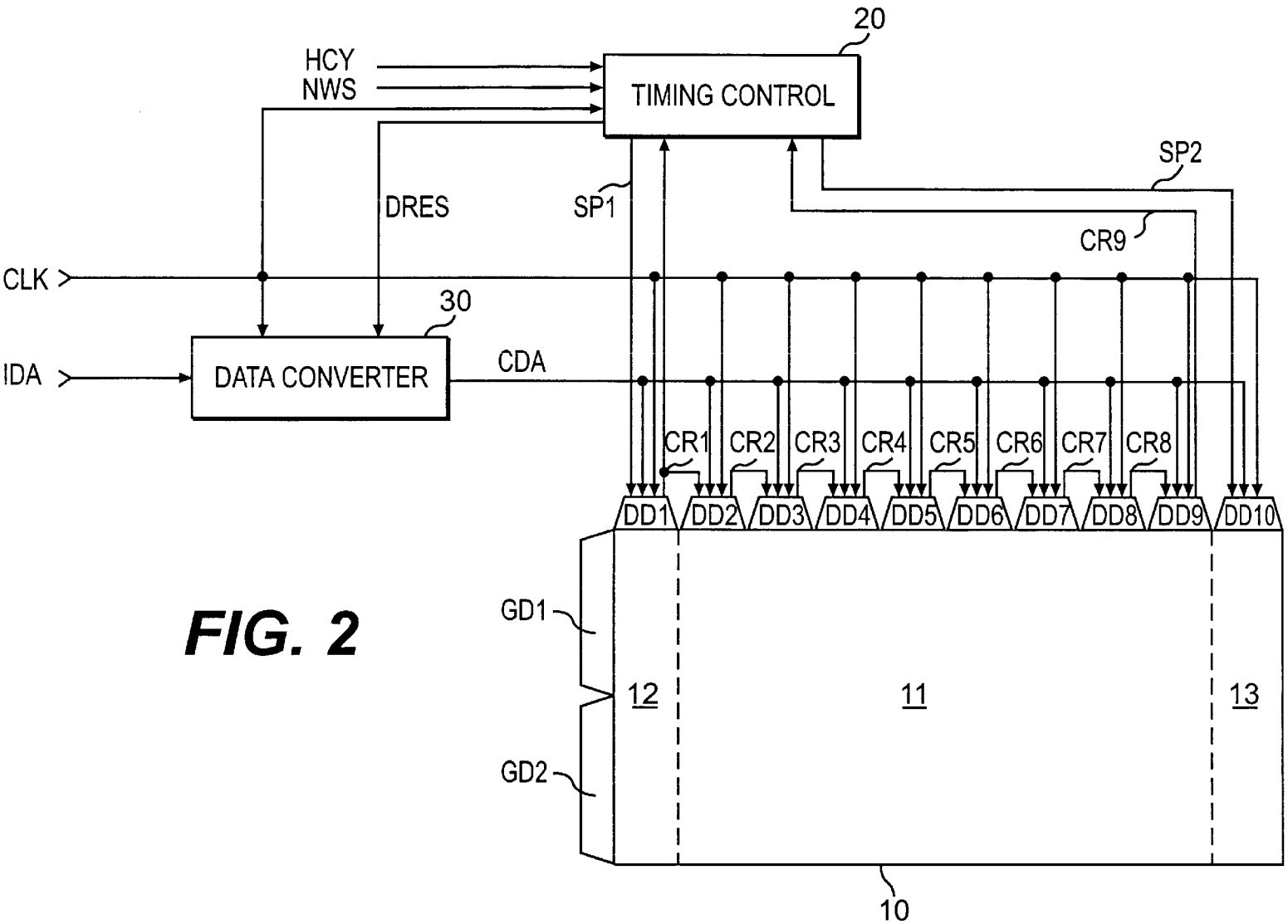
FIG. 2 is a diagram showing a configuration of a liquid crystal display apparatus with a function of displaying a picture of a different aspect ratio according to an embodiment of the present invention.

FIG. 2 schematically illustrates a configuration of a liquid crystal display apparatus having a function of displaying a picture of different aspect ratio in accordance with an embodiment of the present invention. As shown in FIG. 2, this liquid crystal display comprises first to tenth drain electrode drivers DD1 to DD10 arranged at the upper side of a liquid crystal panel 10, and first and second gate electrode drivers GD1 and GD2 arranged at the left side of the liquid crystal panel 10. The liquid crystal panel 10 is preferably an Active Matrix type LCD employing thin film transistors (TFT) formed to have an aspect ratio of 16 to 9. Also, the liquid crystal panel 10 has 800 pixels arranged in the horizontal axis and 400 scanning lines in the vertical axis. Further, the liquid crystal panel 10 has 2400 drain electrodes arranged in the horizontal axis and 480 gate electrodes arranged in the vertical axis to thereby drive a red, green, and blue color per a pixel for displaying a color picture.

First to tenth drain electrode drivers DD1 to DD10 drive the 2400 drain electrodes, each driving 240 of them. The second to ninth drain electrode drivers DD2 to DD9 drive drain electrodes positioned in the central region 11 where a normal picture with the aspect ration of 4 to 3 is displayed. Further, the first and tenth drain electrode drivers DD1 and DD10 drive drain electrodes positioned in the left and right side region 12 and 13 of the normal display region, respectively. The second to ninth drain electrode drivers DD2 to DD9 are connected in cascade and sample picture data sequentially. On the other hand, the first and second gate electrode drivers GD1 and GD2, arranged at the left side of the liquid crystal panel 10, drive by dividing the 480 gate electrodes into upper and lower portions of 240 gate electrodes each, respectively. Also, the first and second gate electrode drivers GD1 and GD2 are driven complimentary to each other.

Moreover, the liquid crystal display apparatus 10 according to the above embodiment of the present invention comprises a timing control 20 for controlling a picture data sampling time of the first to tenth drain electrode drivers DD1 to DD10, and a data converter 30 for converting picture data to be supplied for the first to tenth drain electrode drivers DD1 to DD10. A common clock signal CLK is applied to the first to tenth drain electrode drivers, the timing control 20, and the data converter 30.

The timing control 20 generates the first and second start pulses SP1 and SP2 to be applied to the first and tenth drain electrode drivers DD1 and DD10, respectively, and the data reset signal DRES to be applied to the data converter 30. In order to generate signals SP1, SP2 and DRES, the timing control 20 inputs the clock signal CLK, a horizontal synchronous signal HCY, a normal/wide mode signal NWS, and the first carry signal CR1 from the drain electrode driver DD1; and the ninth carry signal CR9 from the ninth drain electrode driver DD9. The first and second start pulses SP1 and SP2 are respectively generated once per horizontal scanning interval and in a sequence depending on the aspect ratio of a picture to be displayed on the liquid crystal panel 10. The data reset signal DRES also has a different waveform depending on the aspect ratio of a picture to be displayed on the liquid crystal panel 10. A detailed explanation of this aspect of the present invention will now be made with reference to FIGS. 3 and 4.

Figure 3:
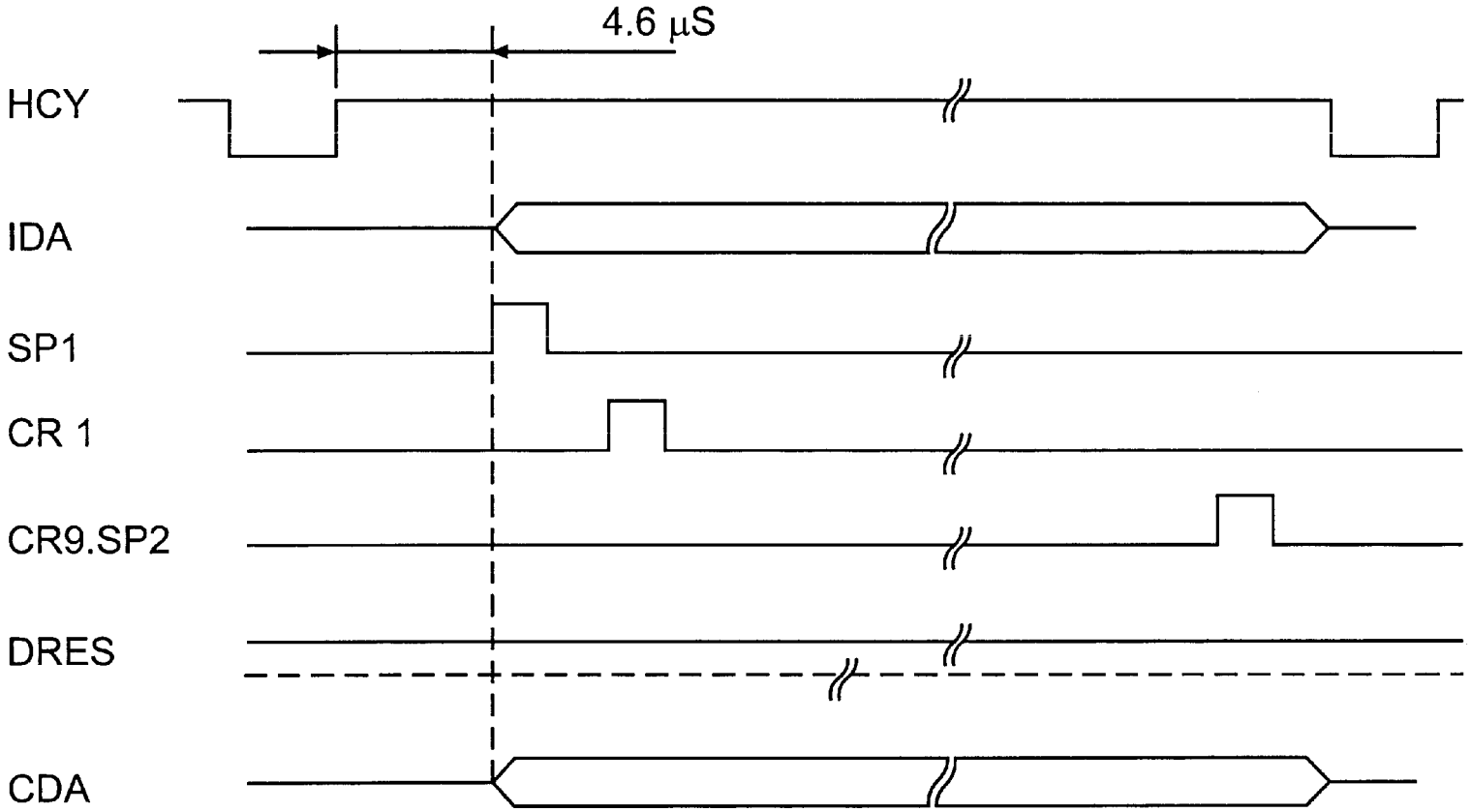
FIG. 3 is a timing chart for sections of the liquid crystal display apparatus shown in FIG. 2, in the wide mode.

FIG. 3 is a timing chart of signals when the normal/wide mode signal NWS remains at a high logic, that is, where a picture with the aspect ratio of 16 to 9 is displayed (wide mode). The first and second start pulses SP1 and SP2 are sequentially generated as shown in FIG. 3. On the other hand, the data reset signal DRES always remains at a specified logic, for example, a high logic, regardless of the start pulses. Further, the first carry signal CR1 is generated by the first drain electrode driver DD1 when it has completed a sampling of the picture data. Likewise, the ninth carry signal CR9 is generated by the ninth drain electrode driver DD9 when it completes a sampling of picture data. This ninth carry signal CR9 has the same phase as the second start pulse SP2.

Figure 4:
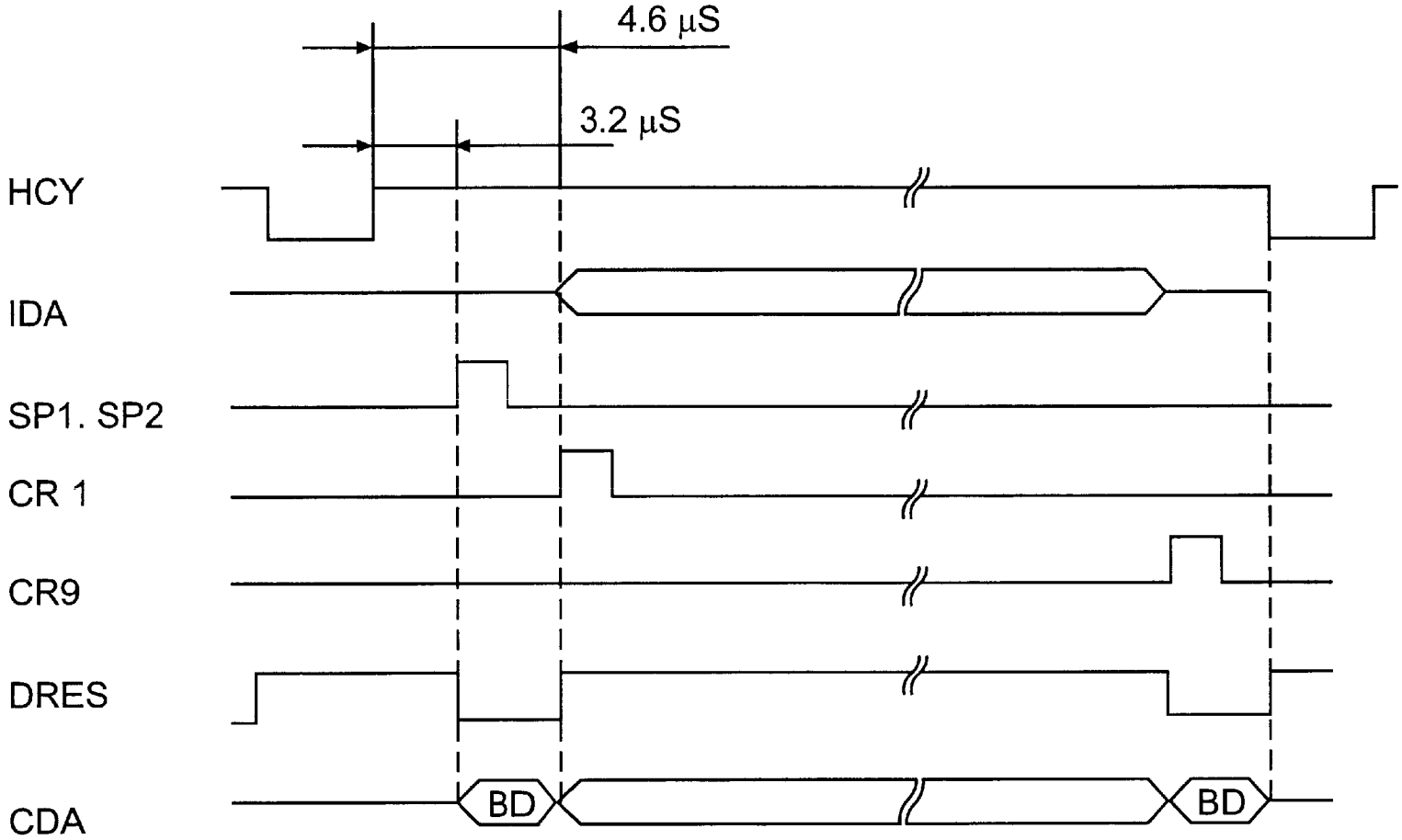
FIG. 4 is a timing chart for sections of the liquid crystal display apparatus shown in FIG. 2, in the normal mode.

Referring now to FIG. 4, there is illustrated a timing of the first and second start pulses SP1 and SP2 in the case where the normal/wide mode signal remains at a low logic, that is, where a picture with the aspect ratio of 4 to 3 is displayed on the liquid crystal panel 10. In this case, the first and second start pulses SP1 and SP2 are simultaneously generated as shown in FIG. 4. The data reset signal DRES maintains a specified logic for example, a low logic in the course of a time interval from the rising edge of the first start pulse SP1 until the rising edge of the first carry signal CR1 and a time interval from the rising edge of the ninth carry signal CR9 until the starting time of the horizontal blanking interval.

Returning to FIG. 2, the data converter 30 selectively converts input picture data IDA in accordance with a logical state of the data reset signal DRES from the timing control 20 to generate the converted picture data CDA. Specifically, the data converter 30 passes the input picture data IDA when the data reset signal DRES is enabled and otherwise blanks the display data.

As a result, the data converter 30 supplies converted picture data identical to the input picture data IDA with the first to tenth drain electrode drivers DD1 to DD10 commonly when the data reset signal DRES remains only at the reference level as shown in FIG. 3. Otherwise, data converter 30 supplies converted picture data CDA having a part of the input picture data IDA replaced with blanking display data BD with the first to tenth drain electrode drivers DD1 to DD10 when the data reset signal DRES has intervals of a specified logic, for example, a low logic level as shown in FIG. 4.

The input picture data IDA is a digitization of an analog image signal performed by an analog to digital converter, and is supplied to data converter 30 via a memory. The picture data is written to data converter 30 by the memory at twice the sampling clock frequency of an analog to digital converter. The memory (not shown), writes the digital data to data converter 30. Further, at the time of reading out the picture data to the data converter, the memory begins to read in picture data when 4.6 $\mu$s elapses from a start point i.e., a rising edge of the horizontal scanning interval. The memory reads out the picture data for a period of 21.54 $\mu$s when a wide picture is displayed on the liquid crystal panel 10, and reads out the picture data for a period of 20.16 $\mu$s when normal picture having a 4 to 3 aspect ratio is to be displayed. According to these picture display modes, a frequency of the sampling clock of the analog to digital converter and a frequency of the writing and reading clock of the memory have values as shown in Table I, below.

TABLE I

| Mode | Frequency | |
|---|---|---|
| | Frequency of the sampling clock of the A-D converter | Frequency of the writing and reading clock of the memory |
| Wide mode (64 ns) | 0 15.59 MHz (32 ns) | 31.18 MHz |
| Normal mode (80 ns) | 12.60 MHz (40 ns) | 25.20 MHz |

Accordingly, with the wide 16 to 9 aspect ratio, the first start pulse SP1 is produced at timing control circuit 20 when 4.6 μs has elapsed from the start point, (i.e., the rising edge of the horizontal scanning interval); while, with the normal 4 to 3 aspect ratio, it is generated when 3.2 μs have elapsed from the start point. Also, the input picture data IDA includes red(R) data, green(G) data, and blue (B) data.

A process in which the first to tenth drain electrode drivers DD1 to DD10 sample the converted picture data CDA according to first and second start pulses SP1 and SP2 produced at the timing control 20 will now be explained in detail for the wide and normal picture. Initially, if the wide picture is displayed on the liquid crystal panel 10, the first and tenth drain electrode drivers DD1 and DD10 are sequentially enabled by the first and second start pulses SP1 and SP2, as shown in FIG. 3, to sample the converted picture data CDA from the data converter 30. In the period extending from the time when the first drain electrode driver DD1 completes the sampling of the converted picture data CDA to the time when the tenth drain electrode driver DD10 initiates the sampling of the converted picture data CDA, the second to ninth drain electrode drivers DD2 to DD9 sample the converted picture data CDA sequentially. This is because each of the second to ninth drain electrode drivers DD2 to DD9 input the carry signals CR1 to CR8 from the preceding drain electrode drivers as start pulses. The first drain electrode driver DD1 begins sampling of the converted picture data CDA when 4.6 μs has elapsed from the start point of the horizontal scanning interval. At this time, a clock signal CLK applied to the first to tenth drain electrode drivers DD1 and DD10 has a frequency of 31.18 MHZ.

On the other hand, if the normal picture is displayed on the liquid crystal panel 10, drain electrode drivers DDI and DD10 sample the converted picture data CDA simultaneously. This is because the second start pulse SP2 is generated at the same time as the first start pulse SP1, that is, when 3.2 μs have elapsed from the start point of the horizontal scanning interval. At this time, the first and tenth drain electrode drivers DD1 and DD10 sample the blanking display data BD generated by the data converter 30. Subsequently, the second to ninth drain electrode drivers DD2 to DD9 sequentially sample the converted picture data CDA. Further, at the time of sampling the converted picture data CDA, the first to tenth drain electrode drivers DD1 to DD10 sequentially input the picture data corresponding to 80 picture elements or pixels by the unit of one pixel including R, G and B data by means of the clock signal CLK. At this time, a clock signal CLK applied to the first to tenth drain electrode drivers DD1 to DD10 has a frequency of 25.20 MHZ.

Figure 5:
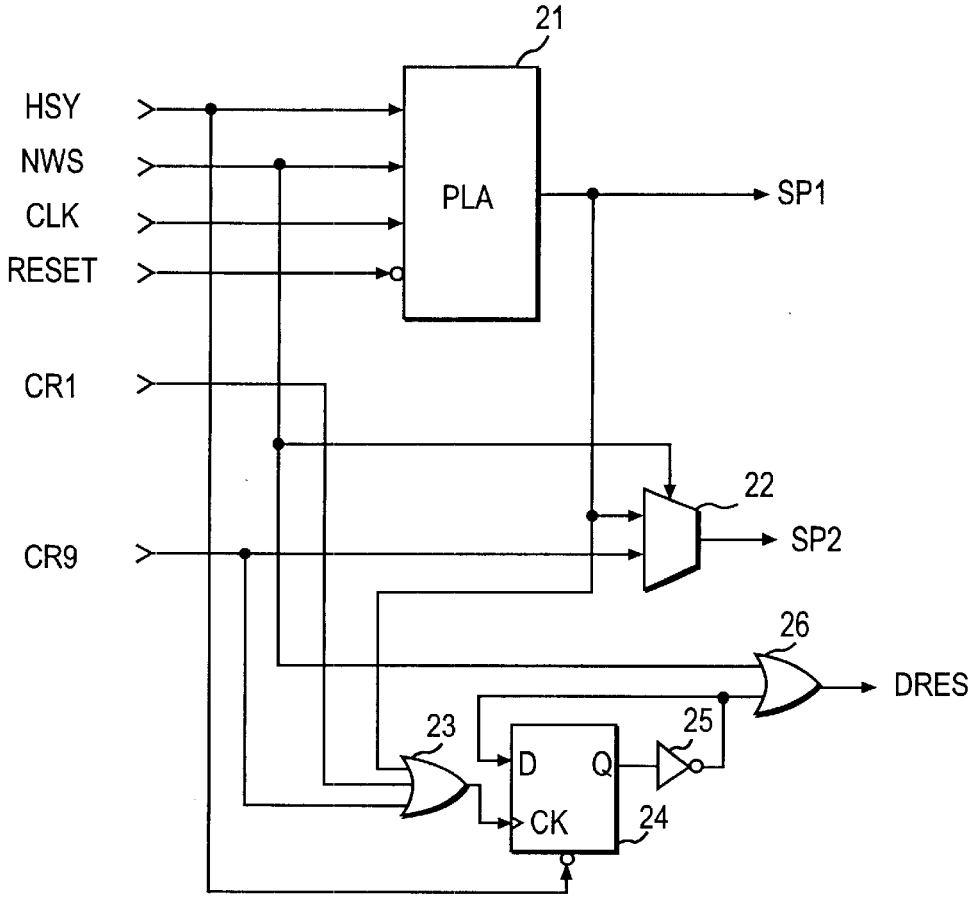
FIG. 5 is a detailed circuit diagram of the control signal generator shown in FIG. 2.

FIG. 5 is a detailed circuit diagram of timing control 20. Referring to FIG. 5, timing control 20 comprises a programmable logic array (PLA) 21 for inputting a horizontal synchronous signal HCY, a normal/wide mode signal NWS, a clock signal CLK, and a reset signal RESET. A multiplexer 22 inputs the normal/wide mode signal NWS as a control signal.

PLA 21 operates on the horizontal synchronous signal HCY, the normal/wide mode signal NWS, the clock signal CLK, and the reset signal RESET to generate the first start pulse SP1 for every horizontal scanning interval. This first start pulse SP1 has a phase difference from the horizontal synchronous signal HCY in accordance with a logical value of the normal/wide mode signal NWS. Specifically, in the case where the normal/wide mode signal NWS remains at a high logic, that is, where the wide picture is displayed on liquid crystal panel 10, the first start pulse SP1 is generated at the time point when 4.6 μs has elapsed from the rising edge of the horizontal synchronous signal, as shown in FIG. 3. On the other hand, in the case where the normal/wide mode signal NWS remains at a low logic, that is, where the normal picture is displayed on the liquid crystal panel 10, the first start pulse SP1 is generated when 3.2 μs has elapsed from the rising edge of the horizontal synchronous signal, as shown in FIG. 4.

Further, the multiplexer 22 supplies one of the first start pulse S1 or ninth carry signal CR9 from the ninth drain electrode driver DD9 to the tenth drain electrode driver DD10 as the second start pulse SP2 in accordance with a logical value of the normal/wide mod e signal NWS. Specifically, the multiplexer 22 selects the ninth carry signal CR9 as the second start pulse SP2 when the normal/wide mode signal remains at a high logic, that is, where the wide picture is displayed on the liquid crystal panel 10; and selects the first start pulse SP1 as the second start pulse SP2 in the case where the normal/wide mode signal NWS remains at a low logic, that is, where the normal picture is displayed on the liquid crystal panel 10. Accordingly, the PLA 21 and the multiplexer 22 control a sampling timing of the first to tenth drain electrode drivers DD1 to DD10 by generating first and second start pulses SP1 and SP2.

Moreover, the timing control 20 further comprises OR gate 23 for inputting first start pulse SP1 and the first and ninth carry signals CR1 and CR9, the first flip-flop 24 for inputting the horizontal synchronous signal HCY to the reset terminal thereof, an inverter 25 connected between an output terminal Q and an input terminal D of the first flip-flop 24, and OR gate 26 for inputting the normal/wide mode signal NWS. Flip-flop 24 initializes a signal in the output terminal Q to a low logic state every horizontal scanning interval delineated by the horizontal synchronous signal HCY. Also, flip-flop 24 latches a signal of the input terminal D to the output terminal Q to thereby invert a signal of the output terminal Q, whenever pulses from OR gate 23, that is, the first start pulse SP1 and the first and ninth carry signals CR1 and CR9 are applied thereto. Meanwhile, the inverter 25 inverts a signal from the output terminal Q of the first flip-flop 24 and feeds it back into the input terminal D thereof. Consequently, the first OR gate 23, the first flip-flop 24, and the inverter 25 allow a range between the first start pulse SP1 and the first carry signal CR1, a range between the first and the ninth carry signals CR1 and CR9, and a range after the ninth carry signal CR9, respectively, to have a certain logical value every horizontal scanning interval, thereby establishing a data blanking region. Finally, OR gate 26 provides an OR operation of the normal/wide mode signal NWS and the output signal of the inverter 25, i.e., the data blanking region signal to generate the data reset signal DRES. This data reset signal DRES remains at a high logic state and hence allows the input picture data IDA to be unchanged in the case where the normal/wide mode signal NWS remains at a high logic, that is, where the wide picture is displayed on the liquid crystal panel 10. On the other hand, it applies the data blanking region signal to the data converter 30 as the data reset signal DRES and allows a part of the input picture data IDA to be changed into the blanking display data, in the case where the normal/wide mode signal NWS remains at a low logic, that is, where the normal picture is displayed on the liquid crystal panel 10.

Figure 6:
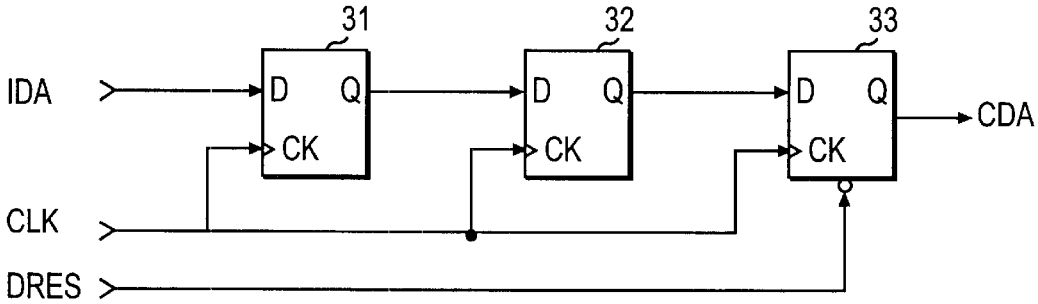
FIG. 6 is a detailed circuit diagram of the blanking treatment portion shown in FIG. 2.

FIG. 6 is a detailed circuit diagram of data converter 30. Referring to FIG. 6, data converter 30 comprises second to fourth flip-flops 31, 32, and 33 connected in cascade. These second to fourth flip-flops 31, 32, and 33 commonly input the clock signal CLK to their clock terminals CK. The second flip-flop 31 latches the input picture data IDA input to the input terminal D of flip-flop 32. Likewise, the third flip-flop 32 latches the output signal of flip-flop 31 to the input terminal of flip-flop 33. Flip-flop 33 supplies the output signal CDA. If the data reset signal DRES of low logic from the second OR gate 26, shown in FIG. 5, is applied to the clear terminal of flip-flop 33, flip-flop 33 outputs blanking display data BD. This blanking display data BD is inserted to the converted picture data CDA only when the normal picture is displayed on the liquid crystal panel 10. Through this structure, noise components are not displayed on the side areas 12 and 13 of the liquid crystal panel 10.

Figure 7:
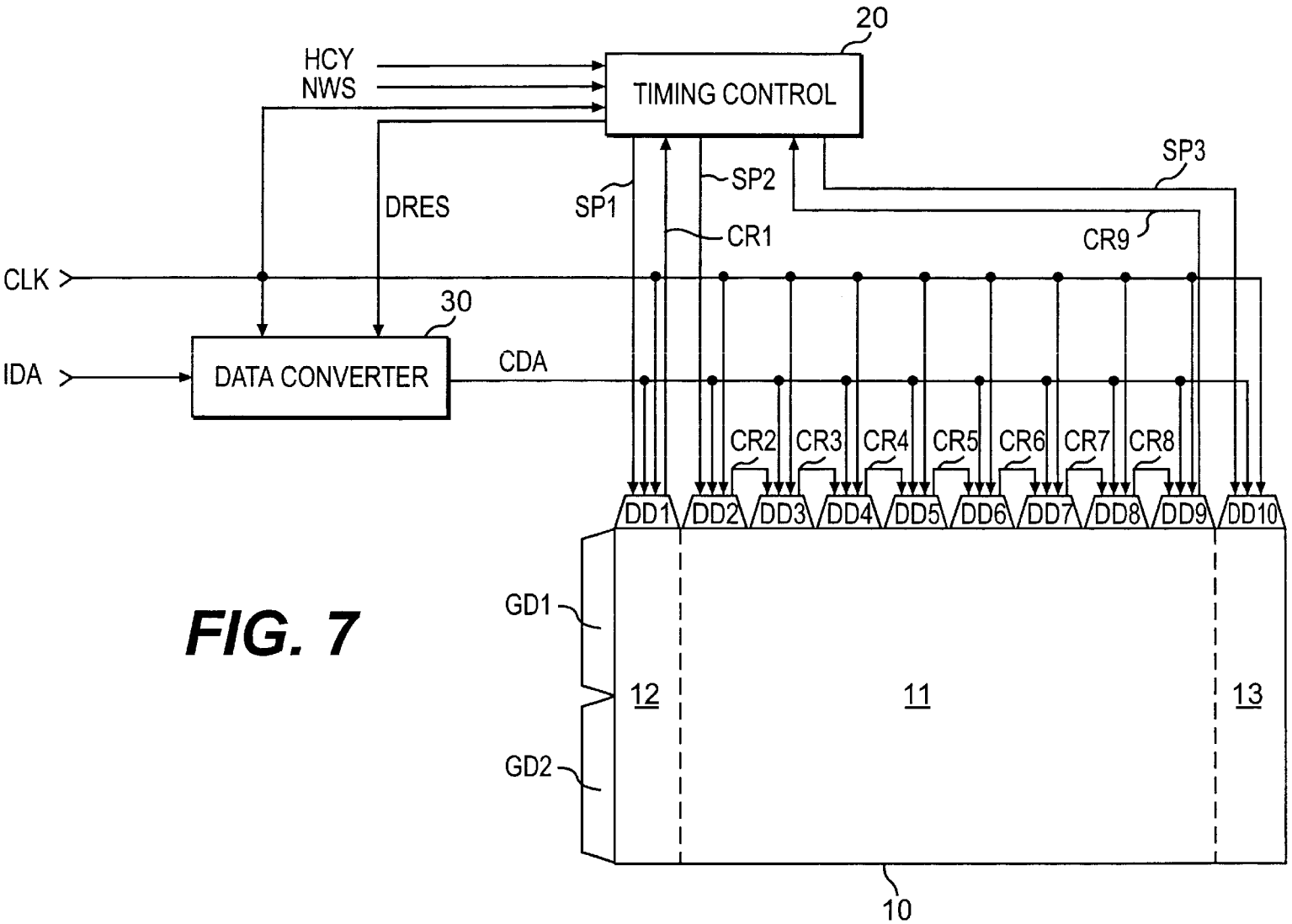
FIG. 7 is a diagram showing a configuration of a liquid crystal display apparatus with a function displaying a picture by a different aspect ratio according to another embodiment of the present invention.

FIG. 7 schematically illustrates a configuration of a liquid crystal display apparatus with a displaying function of a picture of different aspect ratio in accordance with a second embodiment of the present invention. As shown in FIG. 7, this liquid crystal display apparatus comprises first to tenth drain electrode drivers DD1 to DD10 arranged at the upper side of a liquid crystal panel 10, and first and second gate electrode drivers GD1 and GD2 arranged at the left side of he liquid crystal panel 10.

First to tenth drain electrode drivers DD1 to DD10 arranged, in parallel, at the upper side of liquid crystal panel 10 drive the drain electrodes in such a manner that three drain electrodes are assigned to one pixel as red, green; and blue electrodes. The second to ninth drain electrode drivers DD2 to DD9 drive drain electrodes positioned in the central region 11 to form the normal picture. The first and tenth drain electrode drivers DD1and DD10 drive drain electrodes positioned in the left and right side region 12 and 13 of the normal display region, respectively. Drain electrode drivers DD2 to DD9 are connected in cascade with one another to thereby sample picture data sequentially. Gate electrode drivers GD1 and GD2, on the other hand, are arranged at the left side of the liquid crystal panel D and drive the 480 gate electrodes at upper and lower portions, respectively. Also, the first and second gate electrode drivers GD and GD2 are driven complementarily to each other.

Moreover, the liquid crystal display apparatus 10 according to the above embodiment of the present invention comprises a timing control 20 for controlling a picture data sampling time of the first to tenth drain electrode drivers DD1 to DD10, and a data converter 30 for converting picture data to be supplied for the first to tenth drain electrode drivers DD1 to DD10. Also, a clock signal is commonly applied to the first to tenth drain electrode drivers, the timing control 20, and the data converter 30.

The timing control circuit 20 generates start pulses SP1, SP2 and SP3 that are applied to the first, second and tenth drain electrode drivers DD1, DD2 and DD10, respectively, and the data reset signal DRES that is applied to the data converter 30. In order to generate signals SP1, SP2, SP3, and DRES, the timing control circuit 20 inputs the clock signal CLK, a horizontal synchronous signal HCY, a normal/wide mode signal NWS, the first carry signal CR1 from the drain electrode driver DD1, and the ninth carry signal CR9 from the ninth drain electrode driver DD9. The first to third start pulses SP1 to SP3 are generated once per horizontal scanning interval in a sequence depending on the aspect ratio of a picture to be displayed. The data reset signal DRES also become to have a different wave form depending on the aspect ratio of a picture to be displayed on the liquid crystal panel 10. A detailed explanation of these will be done with reference to FIGS. 8 and 9 below.

Figure 8:
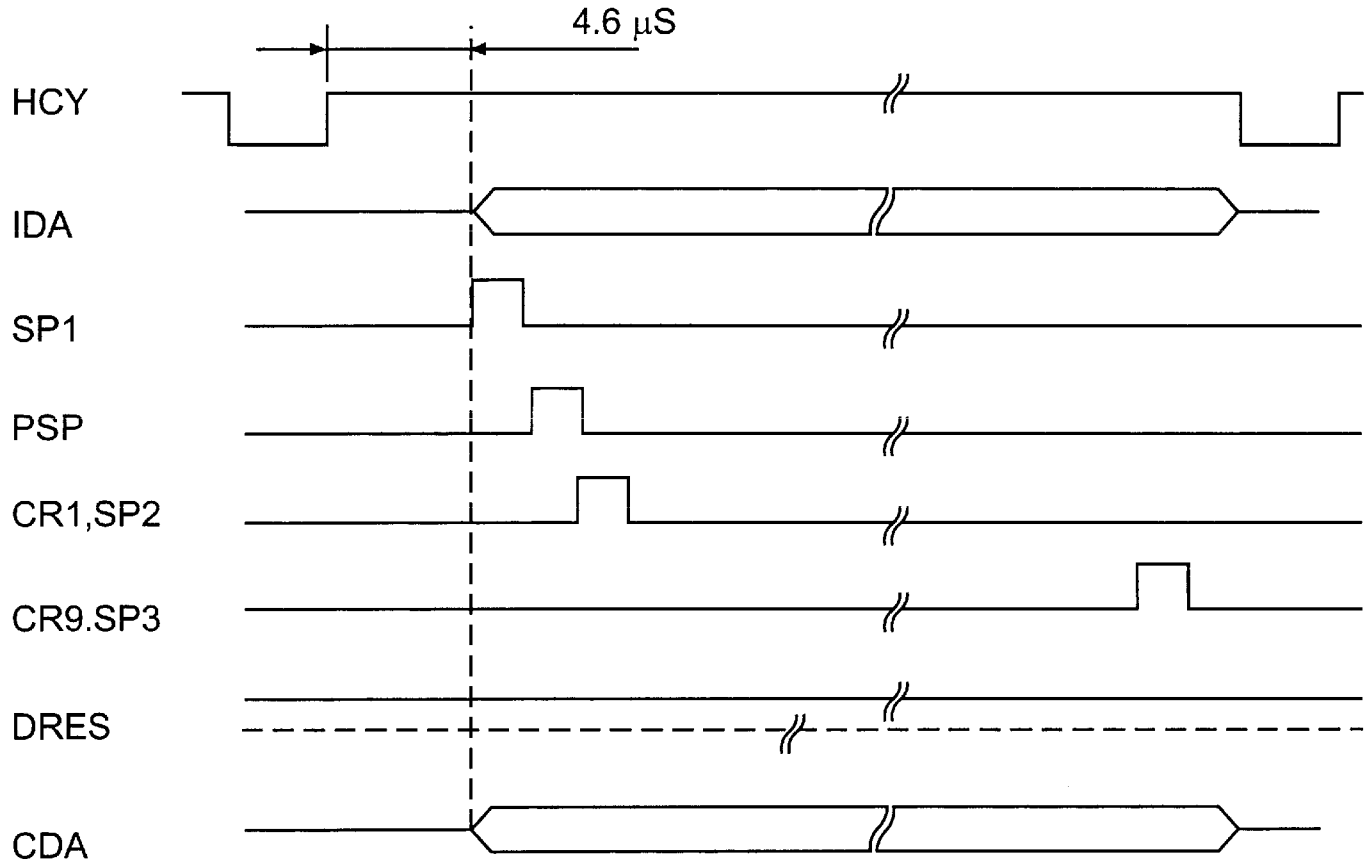
FIG. 8 is a timing chart of the liquid crystal display apparatus shown in FIG. 7, in the wide mode.

FIG. 8 is a timing diagram of certain signals when the normal/wide mode signal remains at a high logic, that is, where a picture with the aspect ratio of 16 to 9 is displayed (wide mode). The first to third start pulses SP1 to SP3 are generated as shown in FIG. 8. The data reset signal DRES always remains at a specified logic, for example, a high logic regardless of the start pulses. The first carry signal CR1 is generated by the first drain electrode driver DD1 when DD1 completes a sampling of picture data. Likewise, the ninth carry signal CR9 is generated by the ninth drain electrode driver DD9 when DD9 completes a sampling of picture data. The first carry signal CR1 has the same phase as the second start pulse SP2 while the ninth carry signal CR9 has the same phase as the third start pulse SP3.

Figure 9:
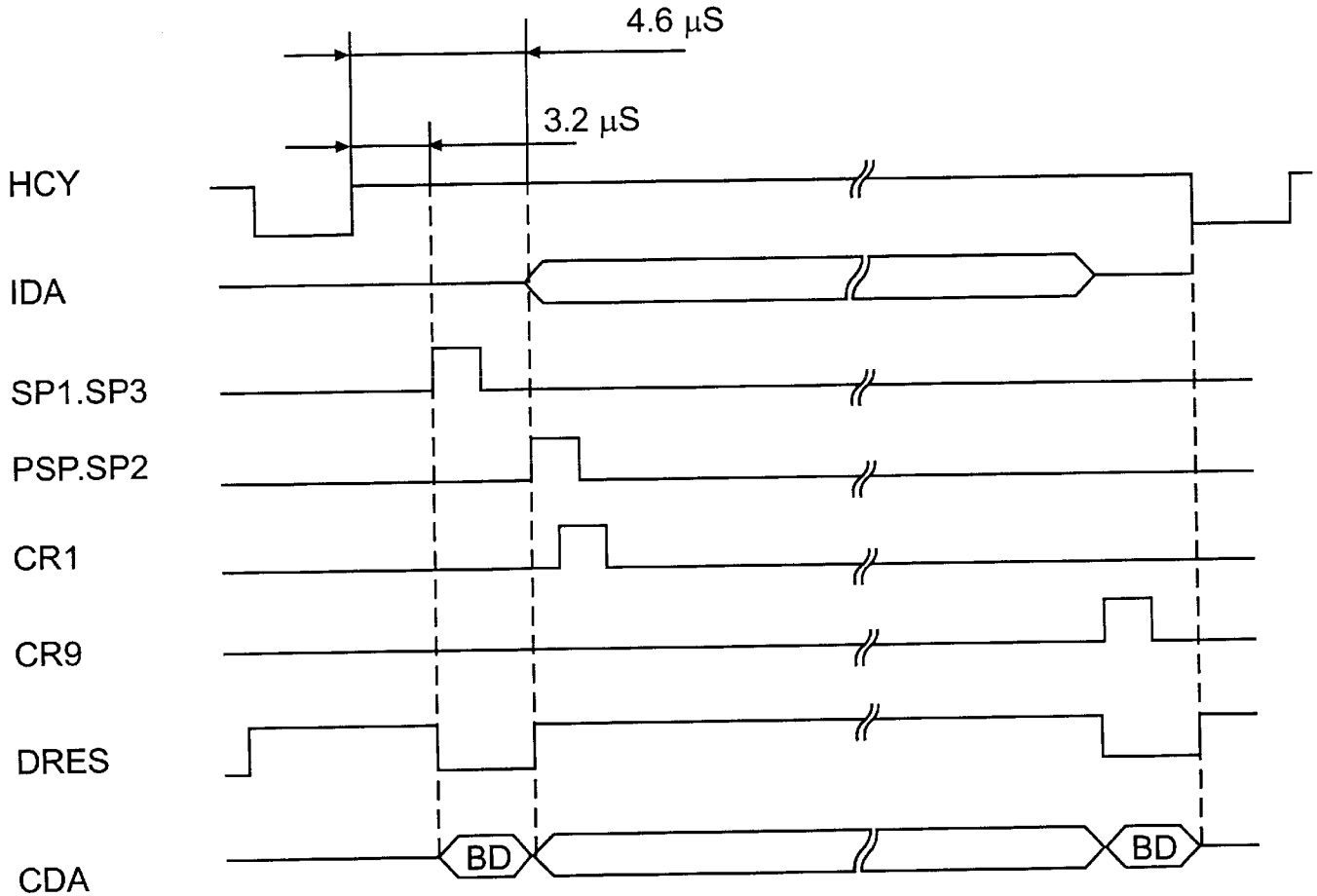
FIG. 9 is a timing chart of the liquid crystal display apparatus shown in FIG. 7, in the normal mode.

FIG. 9 is a timing diagram of certain signals when the normal/wide mode signal remains at a low logic, that is, where a picture with the aspect ratio of 4 to 3 is displayed on liquid crystal panel 10 (normal mode). In this case, the first and second start pulses SP1 and SP2 are sequentially generated as shown in FIG. 8, and the third start pulse SP3 is simultaneously generated with the first start pulse SP1. The data reset signal DRES eventually maintains a specified logic, for example, a low logic level, in the time interval measured from the rising edge of the first start pulse SP1 until the rising edge of the second start pulse S2, and a time interval measured from the rising edge of the ninth carry signal CR9 until the starting time of the next horizontal blanking interval.

Returning to FIG. 7, the data converter 30 selectively converts input picture data IDA in accordance with a logical state of the data reset signal DRES from the timing control 20 to generate the converted picture data CDA. Specifically, the data converter 30 passes the input picture data IDA when the data reset signal DRES is enabled and otherwise blanks the display data.

As a result, the data converter 30 supplies converted picture data identical to the input picture data IDA with the first to tenth drain electrode drivers DD1 to DD10 commonly when the data reset signal DRES remains only at the reference level as shown in FIG. 8. Otherwise, data converter 30 supplies converted picture data CDA having a part of the input picture data IDA replaced with blanking display data BD with the first to tenth drain electrode drivers DD1 to DD10 commonly when the data reset signal DRES has intervals converted from the reference level, i.e., the grounding logic into a specified logic for example, a low logic and converted vice versa.

The input picture data IDA makes a digitization of an analog image signal by an analog to digital converter, and is supplied to data converter 30 via a memory. Further, at the time of reading out the picture data to the converter, the memory begins to read in picture data when 4.6 $\mu$s elapses from a start point i.e., a rising edge of the horizontal scanning interval. The memory reads out the picture data during a period of 21.54 $\mu$s in the case when a wide picture is displayed on the liquid crystal panel 10 and reads out the picture data for a period of 26.16 μs when a normal picture having a 4 to 3 aspect ratio is to be displayed. According to these picture display modes, a frequency of the sampling clock of the analog to digital converter and a frequency of the writing and reading clock of the memory becomes to have values as shown in Table 1 above. Accordingly, the first start pulse SP1 produced at the timing control circuit 20 is when 4.6 μs has elapsed from the start point, (i.e., the rising edge of the horizontal scanning interval); while with the normal 4 to 3 aspect ratio, it is generated when 3.2 μs has elapsed from the start point.

Subsequently, a process in which the first to tenth drain electrode drivers DD1 to DD10 sample the converted picture data CDA by the first to third start pulses SP1 and SP2 produced at the timing control 20 will be explained in detail, by classifying into the case of displaying the wide picture and the case of displaying the normal picture. Firstly, if the wide picture is displayed on the liquid crystal panel 10, then the first, second and tenth drain electrode drivers DD1, DD2 and DD10 are sequentially enabled by the first to third start pulses SP1 to SP3 as shown in FIG. 8 to sequentially sample the converted picture data CDA from the data converter 30. In a period measured from the time when the second drain electrode driver DD2 completes the sampling of the converted picture data CDA until the time when the tenth drain electrode driver DD10 initiates the sampling of the converted picture data CDA, the third to ninth drain electrode drivers DD3 to DD9 sequentially sample the converted picture data CDA. This is caused by the fact that the third to ninth drain electrode drivers DD3 to DD9 input the carry signals CR2 to CR8 from the drain electrode drivers DD2 to DD8adjacent to the left side thereof as start pulses, respectively. The first drain electrode driver DD1 begins sampling of the converted picture data CDA at the time point when a time of 4.6 μs elapses from the start point of the horizontal scanning interval. At this time, a clock signal CLK applied to the first to tenth drain electrode drivers DD1 and DD10 has a frequency of 31.18 MHZ.

On the other hand, if the normal picture is displayed on the liquid crystal panel 10, then the first to tenth drain electrode drivers DD1 to DD10 sample the converted picture data CDA simultaneously. This is caused by the third start pulse SP3 being generated at the same time as the first start pulse SP1, that is, at the time point when a time of 3.2 μs elapses from the start point of the horizontal scanning interval. At this time, the first and tenth drain electrode drivers DD1 and DD10 sample the blanking display data BD generated by the data converter 30. Meanwhile, the second to ninth drain electrode drivers DD2 to DD9 sample the converted picture data CDA sequentially after the sampling of the converted picture data CDA in the first and tenth drain electrode drivers DD1 and DD10 is completed. Further, at the time of sampling the converted picture data CDA, the first to tenth drain electrode drivers DD1 to DD10 sequentially input the picture data corresponding to 80 picture elements or pixels by the unit of one pixel including R, G, and B data by means of the clock signal CLK. At this time, a clock signal CLK applied to the first to tenth drain electrode drivers DD1 to DD10 has a frequency of 25.20 MHZ.

Figure 10:
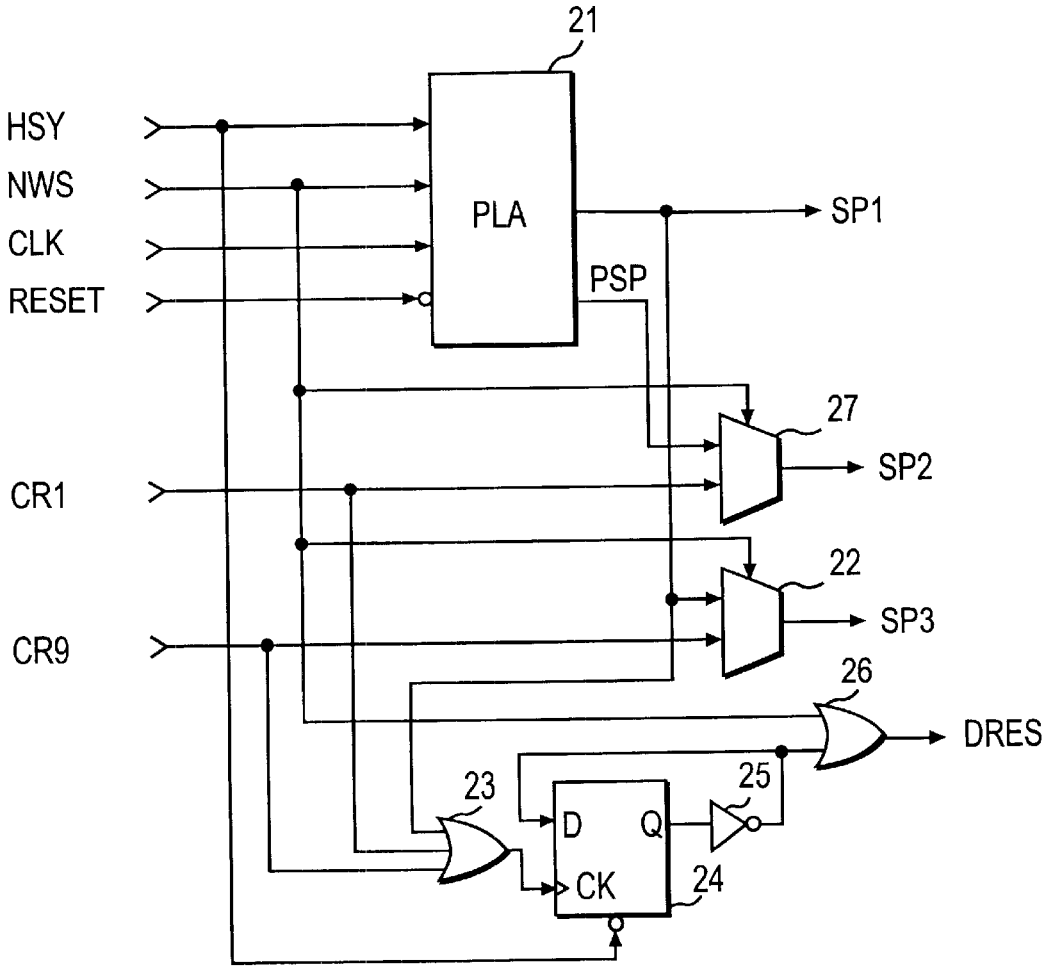
FIG. 10 is a detailed circuit diagram of the control signal generator shown in FIG. 7.

FIG. 10 is a detailed circuit diagram of timing control 20 shown in FIG. 7. Referring to FIG. 10, timing control 20comprises a programmable logic array 21, hereinafter referred simply to as "PLA", inputting a horizontal synchronous signal HCY, a normal/wide mode signal NWS, a clock signal CLK, and a reset signal RESET; and the first and second multiplexer 22 for inputting the normal/wide mode signal NWS as a control signal.

The PLA 21 provides a logical operation of the horizontal synchronous signal HCY, the normal/wide mode signal CLK, the clock signal CLK, and the reset signal RESET to thereby generate both of the first start pulse SP1 and the quasi start pulse PSP for every horizontal scanning interval. This first start pulse SP1 has a phase difference different from the horizontal synchronous signal HCY in accordance with a logical value of the normal/wide mode signal NWS. Specifically, in the case where the normal/wide mode signal NWS remains at a high logic, that is, where the wide picture is displayed on the liquid crystal panel 10, the first start pulse SP1 is generated at the time point when a time of 4.6 μs elapses from the rising edge of the horizontal synchronous signal, as shown in FIG. 8. On the other hand, in the case where the normal/wide mode signal NWS remains at a low logic, that is, where the normal picture is displayed on the liquid crystal panel 10, the first start pulse SP1 is generated when 3.2 μs elapses from the rising edge of the horizontal synchronous signal, as shown in FIG. 9. Similar to this, the quasi start pulse PSP becomes to have a phase difference different from the horizontal synchronous signal HCY, and which is generated at the time point when a certain time, for example, of 1.3 μs elapses from the generation of the first start pulse SP1.

Further, the first multiplexer 22 supplies any one of the first start pulse SP1 and the ninth carry signal CR9 from the ninth drain electrode driver DD9 to the tenth drain electrode driver DD10 as the third start pulse SP2 in accordance with a logical value of the normal/wide mode signal NWS. Specifically, the first multiplexer 22 selects the ninth carry signal CR9 as the third start pulse SP3 in the case where the normal/wide mode signal remains at high logic, that is, where the wide picture is displayed on the liquid crystal panel 10; while it selects the first start pulse SP1 as the third start pulse SP3 in the case where the normal/wide mode signal NWS remains at a low logic, that is, where the normal picture is displayed on the liquid crystal panel 10. Meanwhile, the second multiplexer 27 supplies any one of the quasi start pulse PSP and the first carry signal CR1 from the first drain electrode driver DD1 to the second drain electrode driver DD2 as the second start pulse SP2 in accordance with a logical value of the normal/wide mode signal NWS. Specifically, the second multiplexer 27 selects the first carry signal CR1 as the first start pulse SP1 in the case where the normal/wide mode signal remains at a high logic, that is, where the wide picture is displayed on the liquid crystal panel 10; while it selects the quasi start pulse PSP as the second start pulse SP2 in the case where the normal/wide mode signal NWS remains at a low logic, that is, where the normal picture is displayed on the liquid crystal panel 10. As a result, the PLA 21, the first and the third multiplexers 22 and 27 constitute means for controlling a sampling timing of the first to tenth drain electrode drivers DD1 to DD10 by generating the first to third start pulses SP1 to SP3.

Moreover, the timing control 20 further comprises first OR gate 23 inputting the first start pulse SP1 and the first and ninth carry signals CR1 and CR9, the first flip-flop 24 for inputting the horizontal synchronous signal HCY to the reset terminal thereof, inverter 25 connected between an output terminal Q and an input terminal D of the first flip-flop 24, and the second OR gate 26 for inputting the normal/wide mode signal NWS. Since operations of first OR gate 23, first flip-flop 24, inverter 25 and second OR gate in the above embodiment are identical to those in the preceding embodiment as shown in FIG. 5, an explanation is omitted.

As described above, according to the present invention, sequential control of the picture data sampling time of the first drain electrode driver driving the drain electrodes positioned in a region of the liquid crystal panel on which the normal picture different in aspect ratio from the liquid crystal panel is to be displayed and the picture data sampling time of the second drain electrode driver driving the drain electrodes positioned in a region of the liquid crystal panel on which the normal picture is not to be displayed, so that it becomes possible to display the normal picture having an aspect ratio different from the liquid crystal panel. Also, it becomes possible to display the normal picture having an aspect ratio different from the liquid crystal panel by varying a part of the picture data commonly supplied with the first drain electrode driver driving the drain electrodes positioned in a region of the liquid crystal panel on which the normal picture is to be displayed and the second drain electrode driver driving the drain electrodes positioned in a region of liquid crystal panel on which the normal picture is not to be displayed. According to the present invention, therefore, it becomes possible to display the normal picture having an aspect ratio different from the liquid crystal panel along with the blanking picture in which noise components are not included. Further, the present invention can provide a liquid crystal display apparatus of simplified circuit configuration which can selectively display either of the normal picture having a different aspect ration from the liquid crystal panel or the wide picture having the same aspect ratio as the liquid crystal panel.

Although the present invention has been described by the preferred embodiments illustrated in drawings hereinbefore, it is apparent from the above description to those ordinarily skilled in the art that various changes and modifications of the invention are possible without departing from the spirit thereof. For instance, it should be understood that, although the liquid crystal panel is shown driven by ten drain electrode drivers, the drain electrode drivers for driving the liquid crystal panel may be provided in a number smaller or larger than ten. Further, it should be understood that a resolution of liquid crystal panel different from that, i.e., of 800×RGB480 illustrated in the embodiments of the present invention may be applicable. Moreover, it is to be understood that aspect ratios of liquid crystal panel different from those, i.e., of 4 to 3 and 16 to 9 illustrated in the embodiments of the present invention may be applicable. Accordingly, the scope of the invention should be determined not by the embodiments illustrated and described, but by the appended claims and their equivalents.

What is claimed is:

1. A liquid crystal display apparatus for displaying a picture representing picture data in a selected one of a first aspect ratio and a second aspect ratio being different than the first aspect ratio of a liquid crystal panel, comprising:

first signal electrode driving means for driving signal electrodes in a main region where the picture in the first of second aspect ratio is displayed;

second signal electrode driving signal electrodes in a side region of said main region where the picture in only one of the first and second aspect ratios, but not the picture in the other of the first and second aspect ratios, is displayed; and timing control means for varying a picture data sampling start time of said second signal electrode driving means in accordance with the selected one of said first and second aspect ratios, within a horizontal scanning interval, wherein a sampling frequency of the first and second signal electrode driving means are the same while displaying the second aspect ratio.

2. The liquid crystal display apparatus of claim 1, wherein said timing control means includes means for starting said picture data sampling of one of said first and second signal electrode driving means at a different time than starting said picture data sampling of the other of said first and second signal electrode driving means.

3. A liquid crystal display apparatus as set forth in claim 2, further comprising data converting means, coupled to said first and second signal electrode driving means, for selectively inserting blanking display data into said picture data in accordance with the selected one of said first and second aspect ratios.

4. A liquid crystal display apparatus as set forth in claim 3; wherein said data converting means includes means for inserting said blanking data when the selected aspect ratio is only one of the first and second aspect ratios, but not the other.

5. A liquid crystal display apparatus for displaying a picture representing picture in a selected one of a first aspect ratio and a second aspect ratio, said second aspect ratio being different from the first aspect ratio, of a liquid crystal panel, comprising:

a plurality of signal electrodes on the liquid crystal panel;

a first driving circuit for driving a first group of said plurality of signal electrodes a second driving circuit for driving a second group of said plurality of signal electrodes in a side region of the first group of the signal electrodes, the second driving circuit sampling a picture data earlier than the first driving circuit when the first aspect ratio is displayed, and the second driving circuit sampling a blanking data and the first driving circuit sampling a picture data of the second aspect ratio when the second aspect ratio is displayed; and a timing control circuit for applying a sampling start signal to the first driving circuit to start sampling, a sampling starting time of the second driving circuit varying within a horizontal scanning interval in accordance with the selected one of said first and second aspect ratios, wherein a sampling frequency of the first and the second driving circuits are the same while displaying the second aspect ratio.

6. A liquid crystal display apparatus as set forth in claim 5, wherein the sampling start time of the second driving circuit is earlier than the sampling start time of the first driving circuit when the second aspect ratio is displayed.

7. A liquid crystal display apparatus as set forth in claim 5, further comprising a third driving circuit for driving a third group of the signal electrodes in another side region of the first group of the signal electrodes, a sampling start time of the third driving circuit being earlier than the sampling start time of the first driving circuit when the second aspect ratio is displayed.

8. A liquid crystal display apparatus as set forth in claim 5, wherein the timing control circuit includes a device for selecting between a sampling starting signal provided by the second driving circuit and a carry signal provided by the first driving circuit, and applies the selected signal to a third driving circuit to start sampling.

9. A liquid crystal display apparatus as set forth in claim 5, further comprising a picture data transmission line, wherein the first and second driving circuits receive the picture data from the picture data transmission line.

10. A method of displaying a picture representing picture data in a selected one of a first aspect ratio and a second aspect ratio, said second aspect ratio being different from the first aspect ratio of the liquid crystal panel, the liquid crystal panel including a plurality of signal electrodes on the liquid crystal panel, a first driving circuit for driving a first group of the signal electrodes, and a second driving circuit for driving a second group of the signal electrodes in a side region of the first group of the signal electrodes, the method comprising:

sampling a picture data by the second driving circuit and the first driving circuit sequentially when displaying the first aspect ratio; and sampling a blanking data by the second driving circuit and a picture data by the first driving circuit at a same frequency when displaying the second aspect ratio, and a sampling start time of said second driving circuit varying within a horizontal scanning interval in accordance with the selected one of said first and second aspect ratios.

11. A method as set forth in claim 10, wherein said sampling a blanking data includes sampling the blanking data before sampling the picture data of the second aspect ratio by the first driving circuit when displaying the second aspect ratio.

12. A method as set forth in claim 10, further comprising driving a third group of the signal electrodes in another side region of the first group of the signal electrodes by a third driving circuit, and sampling a blanking data before sampling the picture data of the second aspect ratio when displaying the second aspect ratio.

13. A method as set forth in claim 10, further comprising applying either a sampling starting signal provided by the second driving circuit of a carrying signal provided by the first driving circuit to a third driving circuit as a sampling start signal.

14. A method as set forth in claim 10, further comprising receiving the picture data by the first of second driving circuit via a picture data transmission line.

* * * * *

UNITED STATES PATENT AND TRADEMARK OFFICE

CERTIFICATE OF CORRECTION

PATENT NO. : 6,362,804 B1
DATED : March 26, 2002
INVENTOR(S) : Joon Ha Park et al.

It is certified that error appears in the above-identified patent and that said Letters Patent is hereby corrected as shown below:

Column 11,
Line 58, “of” should read -- or --.
Line 59, “driving signal” should read -- driving means for driving signal --.

Column 12,
Line 17, “3;” should read -- 3, --.
Line 29, after “electrodes”, insert -- ; --.

Column 14,
Line 20, “of” should read -- or --.

Signed and Sealed this

Fifth Day of November, 2002

*Attest:*

*Attesting Officer*

JAMES E. ROGAN
*Director of the United States Patent and Trademark Office*